US005647280A

United States Patent [19]

Höhne et al.

[11] Patent Number: 5,647,280

[45] Date of Patent: Jul. 15, 1997

[54] RAIL LINE, IN PARTICULAR FOR A HIGH-SPEED MAGNETIC TRAIN

[75] Inventors: Hubertus Höhne, Burzbach; Albrecht Demmig, Kirchmöser; Erich Nuding, Aalen, all of Germany

[73] Assignee: BWG Butzbacher Weichenbau GmbH, Butzbach, Germany

[21] Appl. No.: 442,418

[22] Filed: May 16, 1995

[30] Foreign Application Priority Data

May 16, 1994 [DE] Germany ..... 44 17 071.8

[51] Int. Cl.[6] ..... E01B 25/00

[52] U.S. Cl. ..... 104/124; 104/118; 104/125

[58] Field of Search ..... 104/124, 125, 104/126, 118, 119, 121; 105/141, 142, 144, 145, 146, 147

[56] References Cited

U.S. PATENT DOCUMENTS

| | | | |
|---|---|---|---|
| 945,741 | 1/1910 | Butler et al. . | |
| 3,464,365 | 9/1969 | Bertin | 104/125 |
| 3,841,223 | 10/1974 | Bertin | 104/124 |
| 3,861,319 | 1/1975 | Gelhard et al. | 104/124 |
| 4,212,247 | 7/1980 | Lusk | 104/124 |
| 4,221,170 | 9/1980 | Koudelka | 104/125 |
| 5,231,931 | 8/1993 | Sauvageot | 104/124 |
| 5,299,507 | 4/1994 | Maynard | 104/124 |
| 5,360,123 | 11/1994 | Johnston | 104/126 |

FOREIGN PATENT DOCUMENTS

| | | |
|---|---|---|
| 3404061 | 9/1885 | Germany . |
| 4128022 | 2/1993 | Germany . |

OTHER PUBLICATIONS

Alscher et al; "Demonstrationsanlage fur Magnet–schwebetechnik zur Internationalen Verkehrsausstellung (IVA) 1979"; Sonderdruck Aus ETR Eisenbahntechnische Rundschau.

Hilligas et al: "Der Fahrweg der Versuchsanlage Emsland (TVE)" Eisenbahn und Verkehrswesen vol. 105, No. 7/8, Jul./Aug. 1981.

*Primary Examiner*—Mark T. Le

*Attorney, Agent, or Firm*—Dennison, Meserole, Pollack & Scheiner

[57] ABSTRACT

The invention relates to a rail line, in particular for a high-speed magnetic train, comprising supports (10) constituting the rail line, which are placed on girders (12, 14) originating on opposite sides (34, 36) of the support and assigned to it in pairs and rest on the ground (16) or a foundation. To achieve an orientation of the rail line in the desired amount, it has been proposed that the girders (12, 14), which are assigned in pairs to each other, have a distance at the ground which is less than that at the supporting end, wherein the girders, controlled to the necessary extent, are adjustable in a plane extending vertically in respect to the linear axis of the rail line (18) in such a way that the rail line extends inclined in respect to the horizontal line.

5 Claims, 1 Drawing Sheet

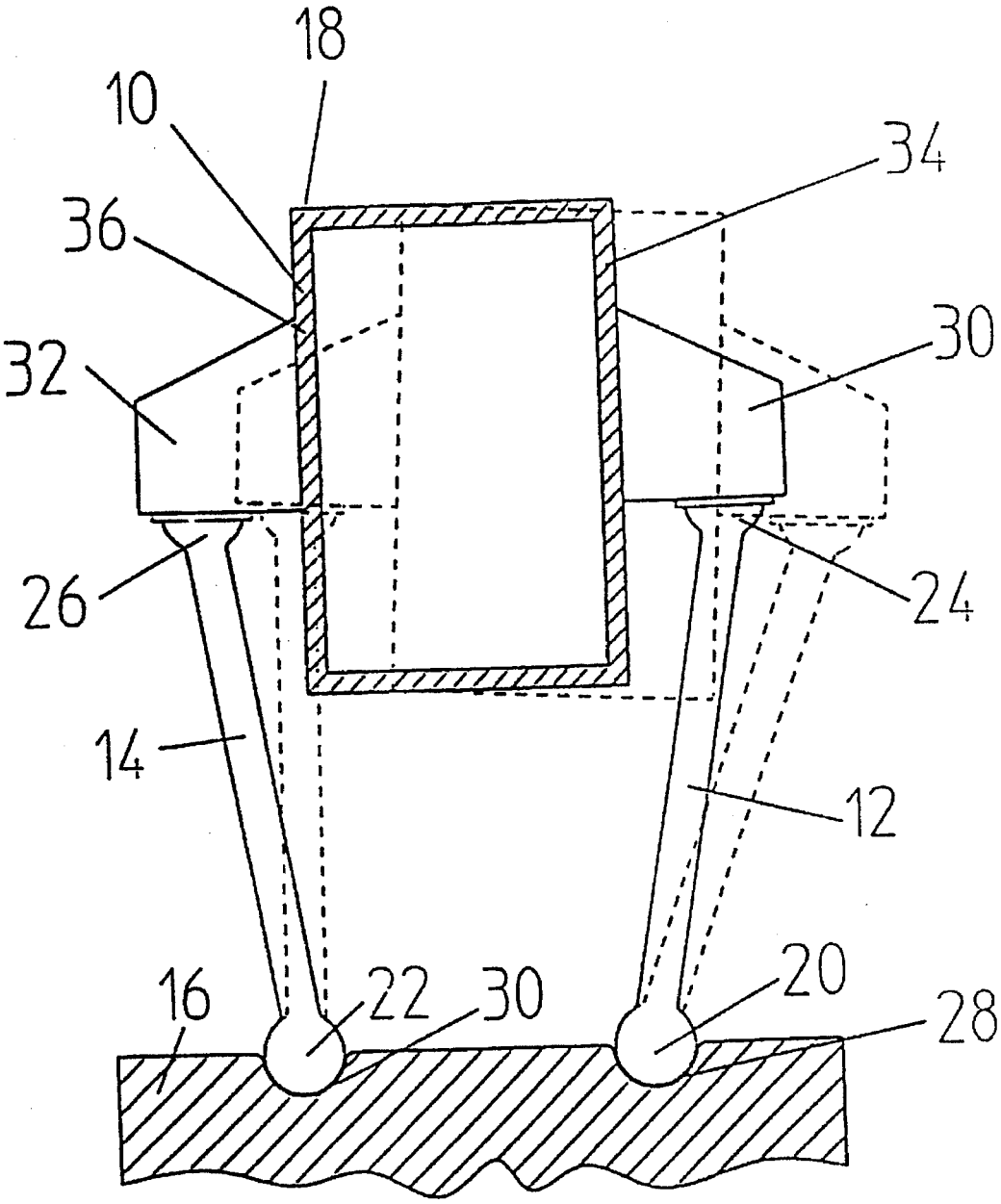
18
10
34
36
30
32
26
24
14
12
16
22
30
20
28

RAIL LINE, IN PARTICULAR FOR A HIGH-SPEED MAGNETIC TRAIN

FIELD OF THE INVENTION

The invention relates to a rail line, in particular for a high-speed magnetic train, comprising supports constituting the rail line, which are placed on girders originating on opposite sides of the support and assigned to it in pairs.

BACKGROUND OF THE INVENTION

The support and guide system of magnetic trains operates in accordance with the electromagnetic levitation principle. It is based on the attractive forces between individually controlled electromagnets disposed in the floor section of the car and the ferromagnetic reaction rails installed below the rail line.

Basically the rail line, which can be a single track or a double track rail line, consists of individual supports of steel or concrete, for example 50 m long. Besides extending on the level ground, the rail line can also be placed on girders. For this purpose the supports are disposed on girders which are fixedly anchored in the ground. In the process, the girders can be columns extending inclined toward each other, whose distance decreases in the direction of the rail line. Girders of concrete with a clear height of 4.50 m, for example, have been proven effective here.

As a result of the construction the rail line, i.e. the free surface above which the car floats at always the same distance, is always horizontal. Because of this, bends or curves in the rail line must have a large radius.

Girders of steel or concrete intended for the rail lines of magnetic levitation trains have been described in a publication by Hans Alscher and Hans-Georg Raschbichler, entitled "Demonstrationsanlage für Magnetschwebetechnik zur Internationalen Verkehrsausstellung (IVA) 1979" [Demonstration Installation of Magnetic Levitation Technology in Connection with the International Transport Exhibition] in a special publication of ETR—Eisenbahntechnische Rundschau [Magazine of Railroad Technology], vol. 4, 1979, pp. 3 to 14, and by Dieter Hilliges and Peter Mölzer, "Der Fahrweg der Transrapid Versuchsanlage Emsland (TVE)" [The Rail Line of the Emsland Transrapid Test Installation] in ZEV-Glas Ann. 105, 1981, No. 7/8, July/August, pp. 205 to 215. Girders can be embodied to be adjustable as well, as can be seen in German Patent Publications DE 41 28 022 A1 and DE 34 04 061 C1. Steel girders for cranes are known from U.S. Pat. No. 945,751.

OBJECT AND SUMMARY OF THE INVENTION

It is the object of the present invention to further develop a rail line of the previously described type, in particular one for a high-speed magnetic train, in such a way that it is possible with a compensated lateral acceleration to provide rail lines with an increased curvature or to adjust supports which constitute the rail line, wherein it is possible to provide a simultaneous banking of the rail line, for example in the area of switches.

This object is attained in accordance with the invention in that the girders, which are assigned in pairs, have a distance at the lower end where they are fixed in the ground which is less than that at the supporting end, wherein the girders or their sections are adjustable in the course of the adjustment of the supports in a plane extending vertically in respect to the linear axis of the rail line in such a way, that the rail line is changed in respect to the horizontal line. For example, in the course of an adjustment of the supports from a straight-ahead position into a turn-off position, the rail line is inclined in respect to the horizontal line.

In accordance with the teaching of the invention the rail line can be banked in curves or switches, i.e. have an inclination in respect to the horizontal line by inclining the girders of sections thereof to the required extent by adjusting the supports.

The girders are a type of elevated piles which are spot-anchored in the ground or at a distance from the ground on a support, as well as on the bearing end in order to allow in this way an orientation to the required extent of the rail line in respect to the horizontal line.

To make possible the gradual adjustment of the rail line surface in respect to the horizontal line without the rail line supports being able to become warped in respect to the girders, a further development of the invention provides that on the girder end the girders are connected with the support or a prop receiving it by means of fasteners which extend flat from the girder or the prop. In this case the fastenings are intended to form a rigidly connected unit with the girder or the prop.

In order to anchor the girders in the ground or the foundation it is provided that the ends of the pivotable or adjustable column-like girders are spherical and are rotatably seated in a correspondingly designed receiver.

The girders can also have spherical end sections on the support side which engage corresponding receivers of the girder or its prop.

Because the girders are designed as elevated piles and are quasi spot-anchored at the bottom as well as the support end, a further option is provided for adjusting the girders in the linear direction of the rail line. By means of this, extensions, such as thermal extensions occurring in the girders, can be compensated.

Further details, advantages and characteristics of the invention ensue not only from the claims, the characteristics found therein—either by themselves or in combination—but also from the following description of a preferred embodiment to be taken from the drawing.

BRIEF DESCRIPTION OF THE DRAWINGS

The FIGURE shows a section through a rail line on girders of a high-speed magnetic train.

DETAILED DESCRIPTION OF THE PREFERRED EMBODIMENT

A support (10) on girders is shown in principle in the drawing, which is a section of a rail line of a high-speed electric train. The support (10), whose geometry in the exemplary embodiment is rectangular in cross section, without this constituting a limitation, has been placed on girders (12), (14) embodied as elevated piles on a foundation (16) or other prop. In this case the girders (12) and (14) are pivotable in the linear direction of the support as well as in a plane extending perpendicularly thereto to an extent that thermal expansions can be absorbed in the support (10) or that the rail line surface (18) of the support (10) can be inclined in respect to the horizontal line represented by dashed lines. In this way banking is achieved in the course of the curve of the rail line or in the switch area. This causes a compensated lateral acceleration with the result that the curve or the switch can have a reduced structural length in comparison to a rail line whose running surface always extends parallel with the horizontal line.

The girders (12), (14) can be pivoted by a force acting on the support for displacing it, for example from a straight-ahead setting to a turn-off setting. The girders (12), (14) are pivoted by this displacement so that the inclination of the track in respect to the horizontal line is automatically changed.

The girders have spherically designed end sections (20) and (22) at the end or side toward the ground as well as correspondingly designed end sections (24) and (26) on the support side, which engage correspondingly designed receivers (28), (30) in the ground or a prop extending therefrom or box-like fastenings (30), (32) which, in turn are connected flat with lateral walls (34), (36) of the support (10) extending parallel with each other.

A rigid connection is obtained by means of the flat fastening which assures that the support (10) cannot move in respect to the girders (12) and (14), so that the running surface maintains the required stability.

To allow tilting of the elevated piles (12) and (14) for adjusting the rail line in respect to the horizontal line, the free distance between the sections (20) and (22) on the ground side of the girders (12) and 14) is less than that of the end sections (24) and (26) on the support side. In other words, the elevated piles or girders (12) and (14) have a negative inclination. By means of this the possibility is provided that an adjustment of the elevated piles or girders (12) and (14) in a plane extending perpendicularly to the linear axis of the support (10) is made possible in a simple manner.

At the same time a desired adjustment in the linear direction of the support (10) is possible by the spot-anchoring of the elevated piles (12) and (14) in respect to the foundation (16) as well as the box-like fastenings (30) and (32).

The elevated piles or girders (12) and (14) can be concrete pilings. Steel posts are of course also suitable. Other structures or materials are also possible.

What is claimed is:

1. A rail line for a magnetic train, comprising: a support extending along a linear axis, said support constituting a portion of a rail line, a pair of girders arranged on opposite sides of the support for holding the support at a position above ground, the girders having upper and lower ends, the lower ends positioned at a predetermined spaced-apart distance at the ground, which spaced-apart distance is less than a spaced-apart distance at the upper ends, the girders being arranged to allow girder movements in a plane extending vertically to the linear axis of the rail line so that the movements of the girders causes the rail line to move with respect to a horizontal plane.

2. The rail line in accordance with claim 1, wherein the support has lateral surfaces extending substantially parallel with each other, a fastening means connected to each of said lateral surfaces, and each of the fastening means including a receiving surface for the upper end of one of said girders.

3. The line in accordance with claim 2, wherein each of the girders has a column-like form, a spherical lower end facing the ground, and each said lower end is seated in a correspondingly designed spherical ground receiver to permit girder movement.

4. The rail line in accordance with claim 2, wherein each said fastening means connected to one of the lateral surfaces of the support has a flat surface in a horizontal plane, and each said girder has said upper end with a corresponding flat surface.

5. A rail line in accordance with claim 2, wherein the fastening means, when connected to one of said lateral surfaces, forms a warp-resistant unit with the support.

* * * * *